United States Patent [19]

Castoe

[11] 4,231,550

[45] Nov. 4, 1980

[54] JACK ADAPTER FOR FRONT END ALIGNMENTS

[76] Inventor: John H. Castoe, 10234 McVine St., Sunland, Calif. 91040

[21] Appl. No.: 96,628

[22] Filed: Nov. 23, 1979

[51] Int. Cl.[3] ..... B66F 3/00

[52] U.S. Cl. ..... 254/124; 254/129; 254/131; 254/134; 187/8.43

[58] Field of Search ..... 187/8.43; 254/77, 120, 254/124, 129, 131, 133, 134

[56] References Cited

U.S. PATENT DOCUMENTS

| | | | |
|---|---|---|---|
| 2,046,657 | 7/1936 | Shultz | 254/133 R |
| 2,687,874 | 8/1954 | Newman | 254/134 |
| 2,689,022 | 9/1954 | Neilson | 187/8.43 |
| 2,830,789 | 4/1958 | MacMillan | 254/124 |

*Primary Examiner*—Robert C. Watson

*Attorney, Agent, or Firm*—Christie, Parker & Hale

[57] ABSTRACT

An adapter for a jack is used in front end alignments to jack up a vehicle in a safe position. The adapter includes a generally horizontally extending elongated rocker arm, with a jack attachment member pivotally secured near the center of the rocker arm. The jack attachment member extends downwardly from the underside of the rocker arm for attachment to the ram of a jack placed on a wheel alignment rack below the front steering control arm of the vehicle. The rocker arm extends laterally away from both sides of the ram. An inner end of the rocker arm is attached to the generally horizontal underside of the steering control arm immediately inside the wheel of the vehicle. This provides a safe location at which to jack up the vehicle. The outer end of the rocker arm is pivotally attached to the top of an elongated upright support arm. A rack attachment member fastens the bottom of the support arm to the wheel alignment rack. This maintains the outer end of the rocker arm at a fixed elevation as the rocker arm pivots upwardly through an angle in response to the vertical stroke of the jack. The vertical force of the jack is transferred to the inner end of the rocker arm to raise upwardly against the safe location on the steering control arm. The inner end of the rocker arm has a bracket for securely fastening the rocker arm to the steering control arm. The bracket is adapted to rock about an axis transverse to the length of the rocker arm for securely attaching to the control arm as the rocker arm is being raised.

11 Claims, 10 Drawing Figures

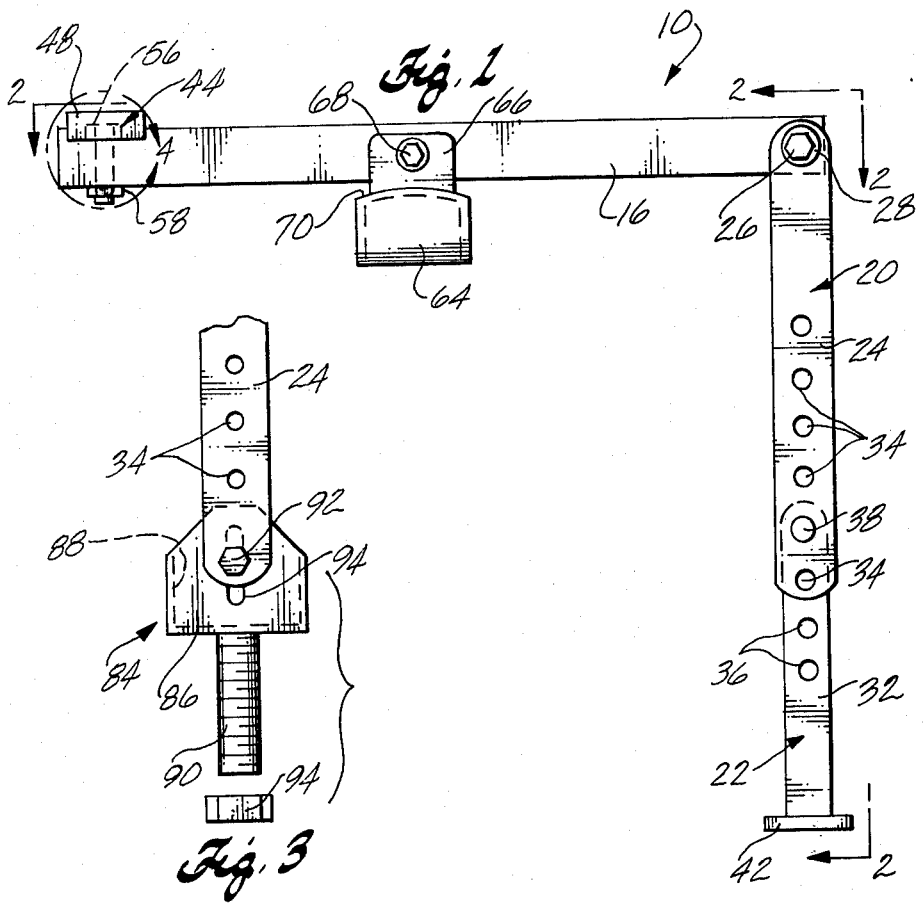
Fig. 1
Fig. 3
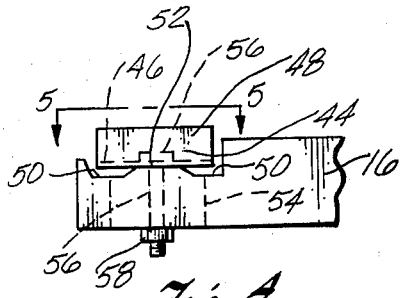
Fig. 4
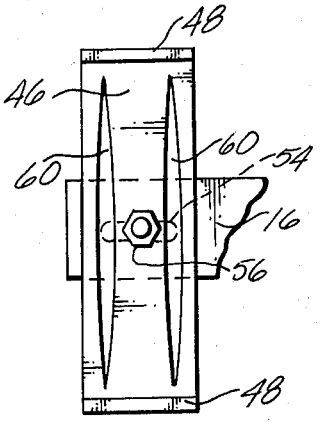
Fig. 5

JACK ADAPTER FOR FRONT END ALIGNMENTS

BACKGROUND

This invention relates in general to an adapter for attachment to a jack used to raise the front end of a vehicle when making wheel alignments. The adapter permits the vehicle to be jacked up and held in a safe position when compared with raising the front end of the vehicle without the adapter.

Automobile mechanics typically perform front end alignments by initially positioning the automobile on a wheel alignment rack. Although wheel alignment racks can vary, they commonly include a pair of spaced apart, parallel runways onto which the automobile is driven. The front wheels of the automobile rest on turntables at the front ends of the runways. The wheels can be steered clockwise or counterclockwise through a given angle in preparation for measuring the toe-in and caster angles of each wheel. The camber setting for each wheel is made by jacking up each wheel above the turntable and then making the necessary camber adjustments to the front end suspension system.

In jacking up the automobile, the jack is typically placed under the front steering control arm of the front suspension system. Wheel alignment racks commonly are equipped with wide pads spaced inside the turntables for supporting a jack below each control arm. The ram of the jack is forced vertically against the bottom of the steering control arm to raise the front end of the automobile. The jack is held in its raised position against the bottom of the steering control arm while the mechanic makes the necessary adjustments to the camber setting.

This is not an entirely safe procedure for making wheel alignments. This is primarily due to the configuration of most steering control arms. The undersurface of the steering control arm immediately adjacent the wheel extends for a short distance in a relatively horizontal direction, but the undersurface of the steering control arm then angles upwardly away from the wheel. When raising the front end, the ram of the jack is commonly forced upward against this angled portion of the steering control arm. This contact is at a dangerous angle that does not provide a stable means of holding the front end of the automobile in its elevated position. There have been many instances where the automobile has either slipped sideways off of the jack, or the automobile has slid entirely off the alignment rack because of the lack of stability created by jacking up against the angular underside of the steering control arm. Jack support pads commonly installed on wheel alignment racks are located below this dangerous angular portion of the control arm. In other wheel aligment racks not having such jack support pads, the jack is typically placed on an adjustable cross-beam that extends between the runways of the rack. In this type of rack, the portion of the cross-beam that supports the jack also is located below the dangerous angular portion of the steering control arm.

Thus, there is a need to provide a means for lifting the front end of a vehicle in a safe position for making wheel alignments. It is also desirable that such a lifting means be compatible with existing types of wheel alignment racks.

SUMMARY OF THE INVENTION

Briefly, this invention provides an adapter for attachment to a vertical jack for lifting against the steering control arm of a vehicle to jack up the vehicle in a safe position. The adapter includes a rocker arm having a working end and a remote end opposite its working end. A jack attachment member is pivotally secured to the rocker arm at an intermediate location spaced inwardly from both the working end and the remote end of the rocker arm. The jack attachment member extends downwardly from the rocker arm and is adapted for attachment to the ram of the jack. A control arm attachment member is secured to and projects upwardly from the working end of the rocker arm for engagement with the steering control arm at a location spaced laterally from the jack. This secures the rocker arm in a fixed stable position on the control arm. A rigid support arm pivots about an axis through the remote end of the rocker arm. The support arm extends downwardly from the rocker arm for attachment to a fixed point on a wheel alignment rack. This maintains the remote end of the rocker arm at a fixed elevation during an upward stroke of the jack, which pivots the rocker arm upwardly through an angle so the working end of the rocker arm is raised upwardly against the steering control arm. This provides means for transferring the lifting force of the jack to the safer, more horizontal location on the steering control arm spaced inwardly from the jack, rather than jacking upwardly against the more angular portion of the steering control arm that is normally contacted by the jack when raising the front end of the vehicle.

These and other aspects of the invention will be more fully understood by referring to the following detailed description and the accompanying drawings.

DRAWINGS

FIG. 1 is a side elevation view showing a jack adapter according to principles of this invention;

FIG. 3 is a fragmentary, side elevation view showing an alternative means for attaching the adapter to a wheel alignment rack;

FIG. 4 is an enlarged, fragmentary side elevation view showing the steering control arm attachment means within the circle 4 of FIG. 1;

FIG. 5 is a fragmentary, top plan view taken on line 5—5 of FIG. 4;

DETAILED DESCRIPTION

Figure 2:
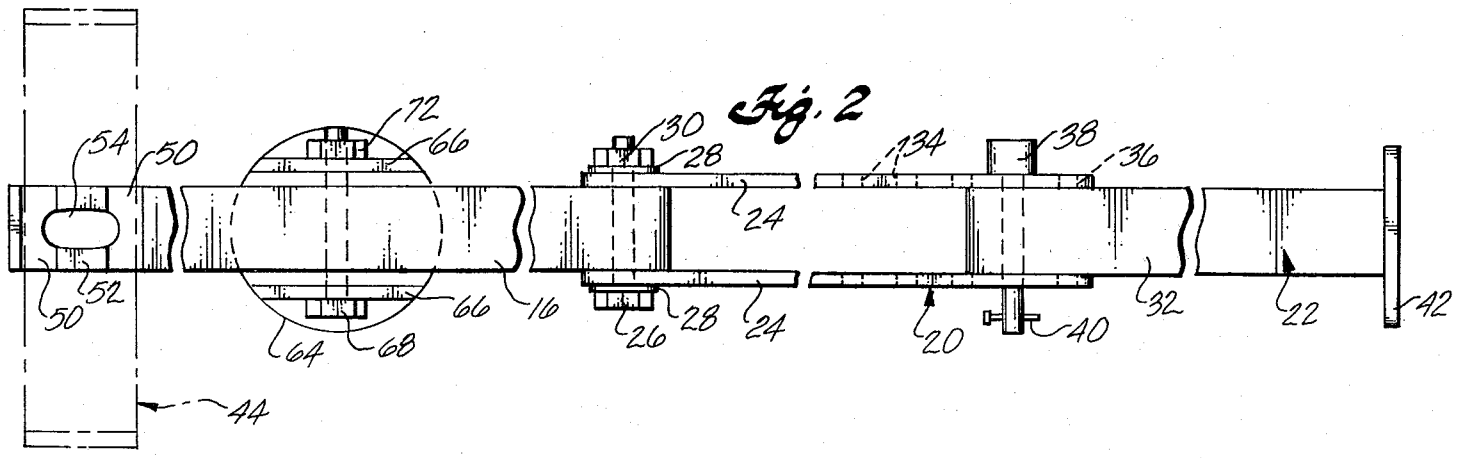
FIG. 2 is a fragmentary, top plan view taken on line 2—2 of FIG. 1.
Figure 8:
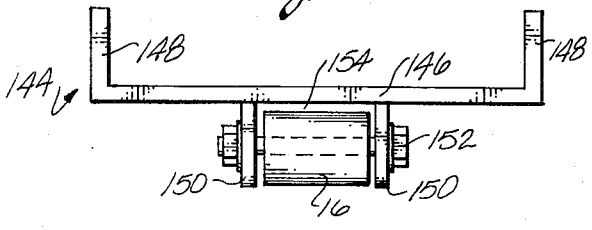
FIG. 8 is an end elevation view showing an alternative means of attaching a control arm attachment member to the end of the rocker arm.
Figure 9:
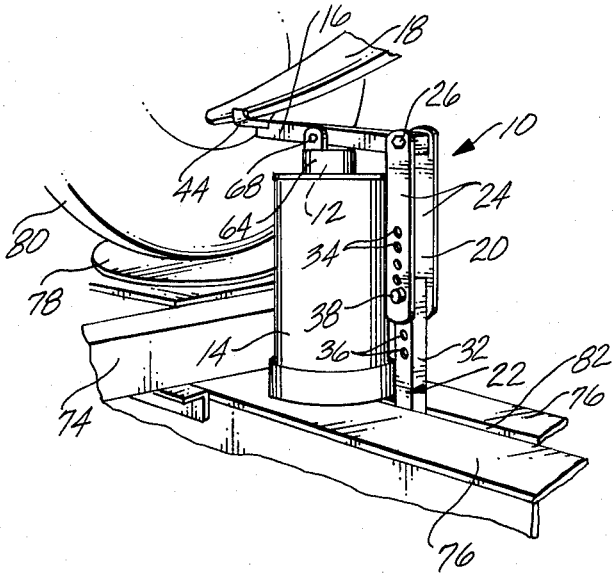
FIG. 9 is a fragmentary, perspective view showing the adapter secured to a jack in preparation for lifting upwardly against a steering control arm.

Referring to the drawings, an adapter 10, shown best in FIGS. 1 and 2, attaches to the ram 12 of a vertical jack 14, as shown best in FIGS. 8 and 9. The adapter includes a rigid, elongated rocker arm 16, preferably of rectangular cross-sectional configuration. The rocker arm is preferably a solid steel bar. When the adapter is in the position shown in FIG. 8, the rocker arm extends in a generally horizontal direction. In this position, the ram of the jack is not yet actuated. FIG. 1 illustrates the adapter in an orientation similar to that of FIG. 8. When the ram of the jack is actuated, as shown in FIG. 9, the upward stroke of the ram transfers a lifting force to a front steering control arm 18 of a vehicle by angular upward movement of the rocker arm. The inner or working end of the rocker arm is attached to the control arm. The outer or remote end of the rocker arm is located on the side of the jack opposite the control arm.

Referring again to FIGS. 1 and 2, the adapter includes an elongated support arm 20 and a rack attachment member 22 releasably secured to the outer of the support arm. The support arm preferably comprises a pair of identical rigid support arm members 24 having their upper portions pivotally attached to the outer end of the rocker arm by a bolt that provides a transverse pivot pin 26. The support arm members 24 are each steel bars that extend parallel to one another and are secured to opposite faces of the rocker arm by the pivot pin 26. The shank of the pivot pin extends through the end of the rocker arm and through washers 28 on opposite faces of the support arm members, and a nut 30 secures the pivot pin in place. The attachment of the support arm members to the rocker arm is a sufficiently loose connection to permit the rocker arm to pivot freely about a transverse axis through the pivot pin. In the orientation of FIG. 1, the support arm members 24 are shown extending vertically downwardly from the underside of the generally horizontally positioned rocker arm.

The rack attachment member 22 includes a rigid, elongated post 32 in the form of a solid steel bar. The post is adapted for releasable attachment to the ends of the support arm members 24 remote from the rocker arm 16. The location at which the post 32 fastens to the support arm members is adjustable along the length of the support arm members so the overall length of the support arm 20 and the rack attachment member 22 can be selectively adjusted. The post 32 is preferably of rectangular cross-sectional configuration and has a width substantially equal to the lateral distance between the parallel support arm members 24. The inside faces of the parallel support arm members lie flat against opposite flat faces of the post 32.

A series of longitudinally spaced apart adjustment holes 34 are drilled in the lower end portions of the support arm members 24. A similar series of longitudinally spaced apart adjustment holes 36 are drilled in the upper portion of the post 32. Adjustment holes 34 are equidistantly spaced apart and those in one member are aligned with those in the other member. Adjustment holes 36 also are equidistantly spaced apart along the post and are spaced apart by the same distance as the spacing between the adjustment holes 34. The overall length of the support arm 20 and the rack attachment member 22 can be adjusted to a preselected amount by moving the post 32 relative to the support arm members 24 so as to align selected adjustment holes 34 and 36 for providing the desired overall length. A transverse safety pin 38 is engaged with the desired adjustment holes 34 and 36 to hold the support arm and rack attachment member in a straight position at the desired overall length. A safety pin key 40 extends through a protruding shank portion of the safety pin to prevent the safety pin from slipping out of position. A flange 42 is formed at the end of the rack attachment member remote from its connection to the support arm members 24.

A control arm attachment member 44 is secured to the working end of the rocker arm opposite the end at which the support arm 20 is attached. In the embodiment illustrated in FIGS. 1 and 2, the control arm attachment member 44 is a channel-shaped steel bracket having an elongated base 46 and a pair of opposite flanges 48 extending upwardly above the rocker arm. The base of the bracket rests on the end of the rocker arm and extends perpendicular to the length of the rocker arm. The length of the base is several times wider than the width of the rocker arm so the upright flanges on opposite sides of the bracket are spaced outwardly from opposite sides of the rocker arm. The length of the base is sufficient to enable the flanges of the bracket to fit around opposite sides of the steering control arm on the particular vehicle with which the invention is used. This distance can vary and several interchangeable control arm brackets of different sizes can be adapted for releasable attachment to the working end of the rocker arm, depending upon the width of the particular vehicle's control arm.

Although the means for attaching the bracket 44 to the rocker arm can vary, it is desired that the bracket be provided with a means for allowing the bracket to rock through an arc that extends in line with the long axis of the rocker arm. This means for rocking the bracket is illustrated best in FIGS. 2, 4 and 5. The bracket is seated in a recessed end portion of the rocker arm. This recessed portion has a pair of laterally extending, spaced apart and parallel recesses 50 on opposite sides of a laterally extending land 52 that protrudes upwardly between the recesses 50. An elongated unthreaded hole 54 extends through the recessed region of the rocker arm with the long axis of the bore 54 being parallel to the long axis of the rocker arm. The base 46 of the bracket is secured to the end of the rocker arm by a bolt 56 that extends through the elongated bore 54. A nut 58 is tightened against the underside of the rocker arm to securely hold the bracket in place. The attachment of the bracket to the rocker arm via the elongated bore permits the bracket to rock back and forth through an arc parallel to the long axis of the rocker arm. Stated another way, the bracket rocks about an axis perpendicular to the long axis of the rocker arm. This provides a self-leveling means of attaching the bracket to the underside of a steering control arm. The upwardly facing surface of the base 46 can have cast serrations 60 to enhance gripping the bracket to the bottom of the steering control arm.

FIG. 8 illustrates an alternative means for rocking the control arm bracket about an axis transverse to the long axis of the rocker arm. In this embodiment, the bracket 144 includes a channel with opposed upper flanges 148 extending above the base 146 of the bracket. A pair of laterally spaced apart lower flanges 150 protrude downwardly along opposite outside faces of the rocker arm 16. A bolt 152 extends through the lower flanges and through the rocker arm to attach the bracket to the rocker arm. A space 154 is provided between the top of the rocker arm and the underside of the bracket to permit the bracket to rock about the axis through the bolt.

A ram attachment member 62 is pivotally secured generally to the central portion of the rocker arm. Although the configuration of the ram attachment member can vary, in the embodiment shown in FIGS. 1 and 2 it comprises an open-ended cap 64 that faces downwardly away from the underside of the rocker arm 16. The cap is preferably circular in cross-section and of a size to fit snugly over the top of the ram of a vertical jack normally used to engage the underside of a steering control arm for raising the front end of a vehicle. The cap 64 has a pair of upwardly projecting ears 66 for extending adjacent opposite outside faces of the rocker arm 16. The ears 66 are pivotally attached to the rocker arm by a bolt 68 that provides a pivot pin to pivot the cap about a transverse axis through the rocker arm. Thus, the cap and the support arm 20 pivot about parallel axes spaced apart along the axes of the rocker arm. The cap has a curved top edge 70 to permit the cap to rock back and forth through an arc extending generally in line with the long axis of the rocker arm. It is preferred that the attachment of the cap to the rocker arm be laterally adjustable; and therefore spacing is provided between each ear 66 and its adjacent side edge of the rocker arm 16. This connection is best illustrated in FIG. 2. A nut 72 on a protruding shank portion of the pivot pin 68 is tightened against an ear of the cap 64 to hold the cap in place on the rocker arm.

Figure 10:
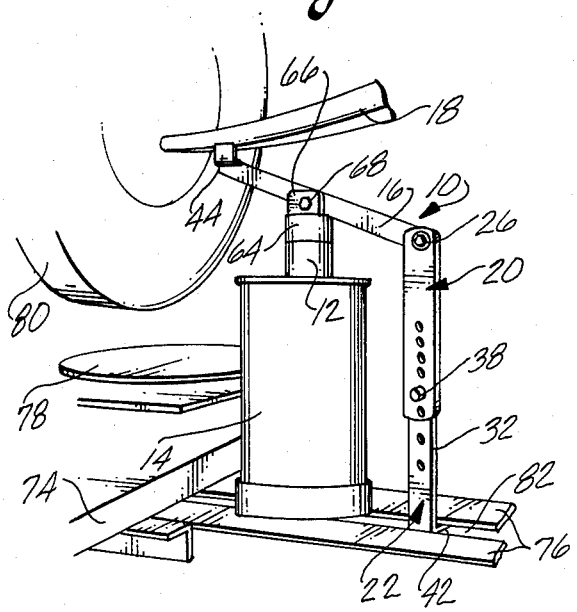
FIG. 10 is a fragmentary, perspective view similar to FIG. 9 showing the adapter in use lifting upwardly against the steering control arm.

FIGS. 9 and 10 best illustrate use of the adapter 10. The jack 14 is shown placed adjacent a runway 74 of a wheel alignment rack. The type of wheel alignment rack with which the adapter can be used can vary. In the rack illustrated in FIGS. 8 and 9, the jack is shown resting on a pair of spaced apart parallel cross-beams 76 of the rack. These cross-beams telescope with similar cross-beams adjacent the other runway of the rack for use in adjusting the spacing between the runways. The jack also can be placed on a jack support pad (not shown) adjacent the runway. The wheel alignment rack also includes a separate turntable 78 on each runway 74. The wheel 80 of the vehicle rests on the turntable 78 in FIG. 8. In this position, the cap 64 of the adapter is attached to the ram of the jack, and the lower portion of the rack attachment member 22 hangs loosely in the space 82 between the cross-beams 76. The rack attachment member and the support arm 20 are positioned on the side of the jack opposite the wheel, and the control arm bracket 44 is attached to the underside of the control arm 18 immediately inside the wheel 80. The rocker arm can be moved laterally somewhat relative to the cap, if necessary, to correctly position the working end of the rocker arm under the control arm. The control arm bracket 44 engages the steering control arm in a safe position near the inside of the wheel where the bottom of the steering control arm is essentially horizontal, i.e., essentially parallel to the plane of the surface on which the jack rests. The control arm bracket securely grips the horizontal portion of the steering control arm. This provides a stable place at which to apply a vertical force to the control arm to lift the front end of the vehicle. The portion of the steering control arm located vertically above the ram of the jack commonly extends upwardly and outwardly from the wheel, at an angle. This location on the control arm does not provide a safe place at which to apply a vertical lifting force via the ram of the jack. The ram of the jack has an essentially flat top surface that does not make safe contact with the angular undersurface of the steering control arm. Such contact is at a dangerous angle that does not provide a stable means for safely holding the front end of the vehicle in an elevated position. I have known of instances where an automobile has either slipped sideways off the jack, or has slid off the alignment rack entirely, or the jack itself has flown out from under the automobile because of the lack of stability produced by poor contact between the ram and the angular undersurface of the steering control arm.

The adapter 10 is shown in FIG. 10 in its operative position in which the wheel 80 is lifted from the turntable 78. The ram 12 of the jack 14 is actuated and the vertical stroke of the ram raises the adapter. This raises the rack attachment member until its flange 42 engages the underside of the parallel cross-beams 76, so that further vertical travel of the ram then causes the outer end of the rocker arm 16 to be held at a fixed elevation above the wheel alignment rack. Continued further vertical travel of the ram then rotates the rocker arm upwardly through an angle about a transverse axis through the pivot pin 26. This raises the working end of the rocker arm and transfers the vertical force of the ram to the generally horizontal undersurface at the inside portion of the steering control arm immediately adjacent the wheel. By transferring the lifting force to this safe position on the control arm, spaced laterally from the jack, the front end of the vehicle can be raised, as shown in FIG. 9, and held in a safe position. The bracket 44 or 144 is able to rock back and forth about a transverse axis at its point of connection to the rocker arm. This accommodates the angle created between the rocker arm and the undersurface of the control arm as the rocker arm is raised. The base of the bracket tends to stay in constant contact with the undersurface of the control arm, i.e., the bracket is self-leveling as the control arm is raised. The bracket can be adapted to fit securely under the control arm, whether the control arm is horizontal or askew from horizontal; and as the rocker arm is raised, the bracket can rock to constantly maintain good contact with the control arm undersurface. The upright flanges fit around opposite sides of the control arm and also assist in stabilizing the attachment of the rocker arm to the steering control arm.

The adapter facilitates use of interchangeable rack attachment members. Such an alternative rack attachment member as shown in FIG. 3, in which the alternative rack attachment 83 includes a generally rectangular lug 86 having an upwardly facing internal recess 88. A threaded shank 90 is rigidly attached to and extends downwardly from the bottom of the lug 86. This rack attachment member can be secured to the bottom portion of the support arm members 24 by a bolt 92 that extends through elongated slotted openings 94 in opposite faces of the lug. A nut (not shown) is threaded onto the opposite end of the bolt 92 for rigidly attaching the lug to the support arm members 24. This rack attachment member can be secured to a wheel alignment rack by drilling a hole in a suitable location on the rack adjacent to where the jack 14 is placed. The threaded shank 90 is then inserted through the drilled hole and the bottom of the lug is tightened against the rack by a nut 94.

The adjustable length of the combined support arm 20 and rack attachment member 22 or 84 can accommodate differences in elevation between the steering control arm and the the particular location on the wheel alignment rack where the adapter is fastened.

Figure 7:
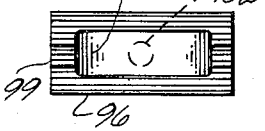
FIG. 7 is a top plan view taken on line 7—7 of FIG. 6.
Figure 6:
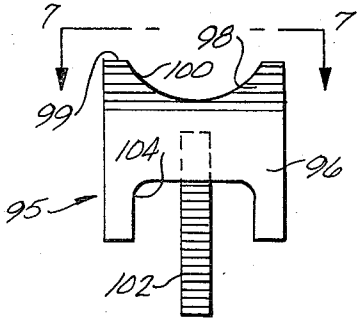
FIG. 6 is a front elevation view showing an alternative means of attachment to a steering control arm.

FIGS. 6 and 7 show an alternative control arm attachment member 95. In some instances, the control arm bracket 44 can be replaced by the attachment member 95 which comprises a lug 96 with opposed, upwardly and inwardly tapered side edges 98, generally flat top edges 99, and a rounded central recessed surface 100. This recessed surface closely adapts to the shape of a control arm undersurface at the position where the upward force is applied by the rocker arm. The lower portion of the lug includes a threaded shank 102 that fits through the elongated bore 54 at the inside end of the rocker arm 16. The nut 58 is tightened on the end of the threaded shank 102 to tighten the lug 96 onto the inner end of the rocker arm. The lug can rock on the end of the rocker arm as described above. A recess 104 in the underside of the lug accommodates the recessed end portion of the rocker arm where the lug is attached. The opposite sides of the recessed surface 100 fit around opposite sides of the control arm to stabilize attachment to the control arm.

The jack attachment member 64 also is interchangeable with other configurations. For example, a jack attachment member (not shown) in the form of a solid downwardly projecting lug can be used. In this instance, the vertical exterior surface of the lug can be releasably engaged with a corresponding internal wall surface configuration of a recess (not shown) in the top of the ram of a jack.

The particular jack attachment member used is pivotally attached to a central portion of the rocker arm for rocking through an arc generally parallel to the length of the rocker arm. This accommodates the angular upward travel of the rocker arm as the jack raises the rocker arm when lifting the vehicle.

Thus, the adapter of this invention releasably attaches to the ram of a jack, and is stabilized by rigidly affixing one end of the adapter to a wheel alignment rack, while securely attaching the working end of the adapter to a safe, generally horizontal portion of the steering control arm so as to lift against this safe portion of the control arm, rather than the more dangerous angular portion.

I claim:

1. An adapter for attachment to a vertical jack for lifting against the steering control arm of a vehicle to jack up the vehicle in a safe position comprising:

an elongated rocker arm having a working end and a remote end opposite its working end;

jack attachment means pivotally secured to the rocker arm between the working end and the remote end of the rocker arm, the jack attachment means extending downwardly from the rocker arm and being configured for releasable attachment to the ram of a jack;

control arm attachment means secured to and projecting upwardly from the working end of the rocker arm for engaging a steering control arm of the vehicle to secure the rocker arm in a fixed position relative to said control arm; and a rigid support arm pivotally secured to the remote end of the rocker arm, the support arm extending downwardly from the rocker arm and having fastening means spaced from the remote end of the rocker arm for attachment to a fixed point to maintain the remote end of the rocker arm at a fixed elevation as the rocker arm pivots through an angle about an axis through the remote end of the rocker arm in response to an upward stroke of the ram of the jack applied to the jack attachment means.

2. Apparatus according to claim 1 in which the jack attachment means has a generally upright wall surface portion extending below a means for pivoting said wall surface portion to the rocker arm.

3. Apparatus according to claim 1 including means for adjusting the length of the support arm.

4. Apparatus according to claim 1 in which the support arm includes at least one support arm member of fixed length pivotally attached to the remote end of the rocker arm; and the fastening means comprises a rack attachment member slidable relative to the length of the support arm member, and means for releasably attaching the rack attachment member to a selected point on the support arm member for adjusting the length of the support arm.

5. Apparatus according to claim 4 including means for releasably fastening to said fixed point an end of the rack attachment member located remote from its attachment to the support arm member.

6. Apparatus according to claim 1 including means for allowing the jack attachment means to slide laterally, with respect to the length of the rocker arm, along the pivot to the rocker arm.

7. Apparatus according to claim 1 including means for allowng the control arm attachment means to rotate through an arc about a transverse axis through the working end of the rocker arm.

8. Apparatus according to claim 1 in which the control arm attachment means includes a generally U-shaped member with opposite flanges protruding upwardly from the rocker arm for supporting opposite sides of a control arm placed in the U-shaped member.

9. Apparatus according to claim 8 in which the support arm includes at least one support arm member of fixed length pivotally attached to the remote end of the rocker arm; and the fastening means comprises a rack attachment member slidable relative to the length of the support arm member, and means for releasably attaching the rack attachment member to a selected point on the support arm member for adjusting the length of the support arm.

10. Apparatus according to claim 9 including means for releasably fastening to said fixed point an end of the rack attachment member located remote from its attachment to the support arm member.

11. Apparatus according to claim 10 in which the jack attachment means has a generally upright wall surface portion extending below a means for pivoting said wall surface portion to the rocker arm.

* * * * *